United States Patent [19]

Toraya

[11] 4,159,858

[45] Jul. 3, 1979

[54] COVER PLATE

[76] Inventor: Juan E. Toraya, 12433 SW. 30th St., Miami, Fla. 33175

[21] Appl. No.: 876,925

[22] Filed: Feb. 10, 1978

[51] Int. Cl.[2] ..... H01R 11/30

[52] U.S. Cl. ..... 339/12 R; 174/57; 339/36

[58] Field of Search ..... 339/12 R, 36, 37, 44 R, 339/44 M, 123; 174/57

[56] References Cited

U.S. PATENT DOCUMENTS

| | | | |
|---|---|---|---|
| 943,958 | 12/1909 | Wheeler | 339/36 X |
| 2,744,243 | 5/1956 | Menendez | 339/36 |
| 3,189,212 | 6/1965 | Bellek | 339/44 R X |
| 3,386,071 | 5/1968 | Allen | 339/36 |
| 3,521,216 | 7/1970 | Tolegian | 339/12 R |
| 3,598,900 | 8/1971 | Drake | 339/36 X |
| 3,868,160 | 2/1975 | Kersman | 339/12 R |
| 3,956,573 | 5/1976 | Myers et al. | 339/36 X |

*Primary Examiner*—Roy Lake
*Assistant Examiner*—DeWalden W. Jones

[57] ABSTRACT

A cover plate to be positioned over an electrical receptacle and fastened to it and which plate includes a main plate with a pair of openings in registry with the electrical sockets of the receptacle and a pivotal cap normally in covering relation of each of the openings and energized sockets, the caps being pivotally connected to the main plate and including a ferrous metal keeper in blocking relation of pivotal movement of each of the caps and in a slot; the keeper is responsive to magnetic forces of attraction to slide in the slot out of blocking relation of pivotal movement of the cap so that a magnet can be used as a key to gain access to the energized receptacle.

5 Claims, 5 Drawing Figures

COVER PLATE

FIELD OF THE INVENTION

This invention relates to escutcheon plates for covering electrical receptacles.

BACKGROUND OF THE INVENTION

In the past many children have been injured by inserting objects into electrical receptacles and it has been recognized that it is important to block this dangerous situation with the result that numerous patents have been issued for devices which have this as a purpose. Representative prior art is found in U.S. Pat. Nos. 2,744,243; 3,386,071; 3,521,216; 3,598,900; and 3,868,160.

It is, generally speaking, an object of this invention to provide an improved escutcheon cover plate which includes a pivotally connected cover cap on the plate which is adapted to be pivotally moved into and out of covering relation of an energized receptacle and a keeper means comprising a ferrous keeper member of metal normally in blocking relation of pivotal movement of the cap and which keeper is adapted to be moved by a magnet in a slot out of blocking relation so that the cap can be opened and which provides a magnetic key; and it is generally an object of this invention to provide a device of the type described which is simple in construction and inexpensive to manufacture and which is readily operated and which is useful for safety purposes.

In accordance with these and other objects which will become apparent hereinafter, the instant invention will now be described with reference to the accompanying drawing, in which:

DESCRIPTION OF THE PREFERRED EMBODIMENT

Figure 1:
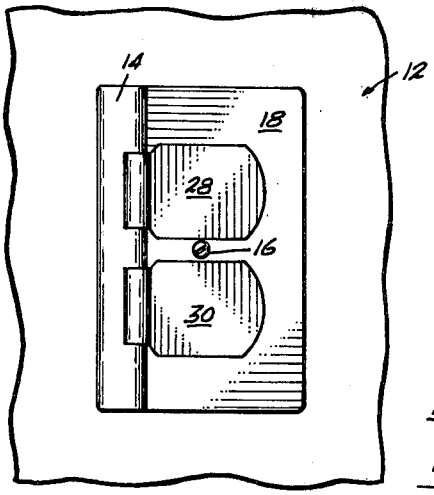
FIG. 1 is a side elevation view of a wall socket provided with the instant invention.
Figure 2:
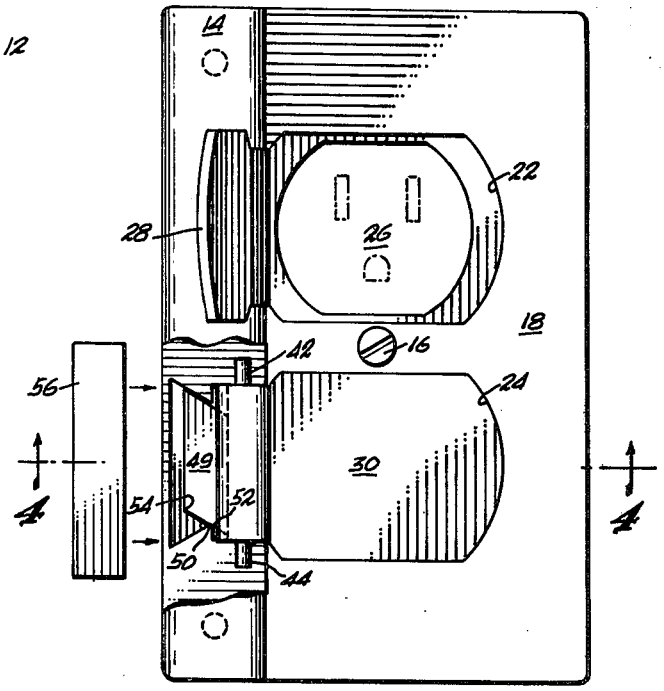
FIG. 2 is a front elevation view partially broken away and illustrating the cover plate of the instant invention.
Figure 3:
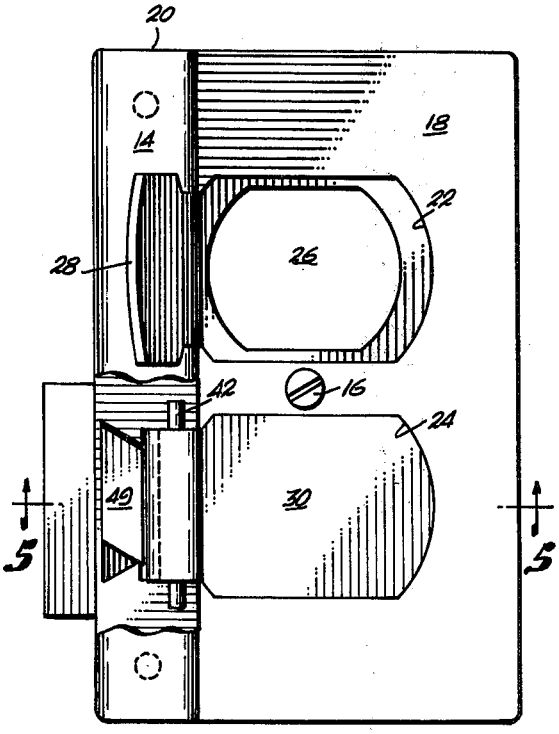
FIG. 3 is a view similar to FIG. 2 and illustrating the device in a different attitude in use, as is described more full hereinafter.
Figure 4:
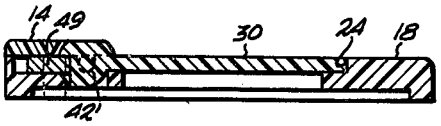
FIG. 4 is a view in cross section taken on the plane indicated by the line 4—4 of FIG. 2 and looking in the direction of the arrows.
Figure 5:
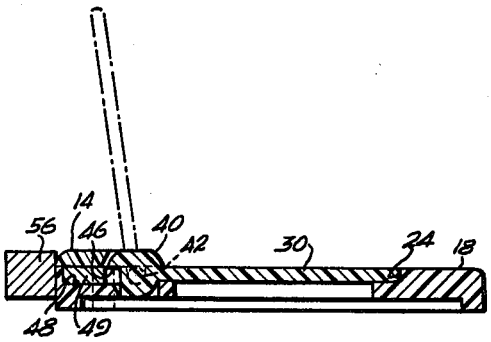
FIG. 5 is a view taken on the plane indicated by the line 5—5 of FIG. 3 and looking in the direction of the arrows.

Referring to the drawings and particularly to FIG. 1, there is shown a section of a wall and the plate is generally designated by the arrowed line 12. It comprises a main zone 18 which is screwed to a wall receptacle as by the bolt 16 in a conventional manner over a pair of energized sockets and, as shown, there is provided a side portion 14 having an upper edge 20 as is described more fully hereinafter. Within the main portion 18 of the plate, there is, preferably, a recess, such as 22 and another recess 24. The recesses each form a shelf about an opening, such as the upper opening 26. Pivotally connected caps or lids 28 and 30 are provided for covering each of the openings, each lid, 28 and 30, being sized to nest on the shelf within the recess as indicated at 24 in FIGS. 4 and 5, where the same are shown in cross section. It will be seen that each lid is pivotally connected to the side portion 14 by means of pivot pins such as that designated by the numeral 42 and that the edge 40 of each cap has a hole through which the pivot pin extends. There is cut-out portion 46 defining a shoulder which extends into a slotted space above the floor 48. Into and out of this space a magnetized member 49, captivated by the structure shown, is adapted to move in sliding relation on the surface 48 and over the corner 50 when the magnet 56 is positioned adjacent the side of the cover plate. For example, when the magnet is not located adjacent the side of the plate, the member 49 will be in the recess which is sized to mate with it in the position shown in FIG. 2. That is, with a portion 52 in blocking relation of the rotation of the plate 30. Similar structure is provided with respect to the cover lid cap 28. At any rate, when the magnet is moved to the position shown in FIG. 3, the member 49 will be moved outwardly by the forces of attraction so that the surface 46 clears the member 49 as the member 49 slides outwardly on the surface 48 under the magnetic influence 56 and, thereafter, the cover 30 may be rotated pivotally as shown by the chain dot line out of covering relation of the electrically energized socket beneath it.

It will be seen that the corner 50 comprises a guide corner or slide corner 50 so that the movement of the keeper member under the influence of the magnet is upwardly and, hence, when the magnet is removed, the forces of gravity will cause the keeper member to slide down into a normal position of blocking relation of pivotal movement.

What is claimed is:

1. A safety lock escutcheon plate adapted to be positioned in covering relation of an energized electrical receptacle, said plate having an opening and a cap in covering relation of the opening, pivot means connecting the cover to the escutcheon plate, said plate having a socket adjacent the cap and keeper means in the socket and in blocking relation of pivotal movement of the cap, said keeper means comprising a ferrous metal member and a magnet means for moving the ferrous metal member into and out of blocking relation of pivotal movement for gaining access through the opening by using the magnetic member as a key.

2. The device as set forth in claim 1 wherein said plate includes a pair of openings.

3. The device as set forth in claim 1 wherein said plate includes means for mounting said plate to a receptacle.

4. The device as set forth in claim 1 wherein said pivot means includes a shoulder defining a generally radially outwardly extending surface in blocking engagement to cam against said keeper means ferrous metal member.

5. The device as set forth in claim 1 wherein said escutcheon plate defines a slot adjacent the cap and said slot includes guide means to constrain movement of the keeper means vertically upwardly in a predetermined path of travel whereby, when the magnetic forces are removed, the keeper means will move under the influence of gravity into blocking engagement of pivotal movement of the cap relative to said plate.

* * * * *